US008462073B2

(12) United States Patent
Shachar

(10) Patent No.: US 8,462,073 B2
(45) Date of Patent: Jun. 11, 2013

(54) EMBEDDED PRINTED EDGE-BALUN ANTENNA SYSTEM AND METHOD OF OPERATION THEREOF

(75) Inventor: Aviv Shachar, Ramat-Gan (IL)

(73) Assignee: Motorola Solutions, Inc., Schaumburg, IL (US)

( * ) Notice: Subject to any disclaimer, the term of this patent is extended or adjusted under 35 U.S.C. 154(b) by 383 days.

(21) Appl. No.: 12/848,129

(22) Filed: Jul. 31, 2010

(65) Prior Publication Data

US 2012/0026061 A1 Feb. 2, 2012

(51) Int. Cl.
*H01Q 1/50* (2006.01)
*H01P 11/00* (2006.01)

(52) U.S. Cl.
USPC ..... 343/859; 343/821; 29/601

(58) Field of Classification Search
USPC ..... 343/859, 795, 820, 821; 29/601
See application file for complete search history.

(56) References Cited

U.S. PATENT DOCUMENTS

| | | | | |
|---|---|---|---|---|
| 6,876,331 | B2 * | 4/2005 | Chiang et al. | 343/702 |
| 2004/0046694 | A1 * | 3/2004 | Chiang et al. | 342/360 |
| 2006/0044195 | A1 | 3/2006 | Arkko et al. | |
| 2012/0026061 | A1 * | 2/2012 | Shachar | 343/859 |

FOREIGN PATENT DOCUMENTS

WO 99/21245 4/1999

OTHER PUBLICATIONS

International Search Report and Written Opinion dated Sep. 29, 2011 in related case PCT/US2011/044174.
"A Broadside-Edge-Coupled Viatess Balun" dated 2003 by Raghu H. Settaluri and Andreas Weosshaar—2003 IEEE MTT-S Digest IFWE-14.
Wideband Balanced Folded Dipole Antenna with a Dual-Arm, Monopole Structure for Mobile Handsets dated 2008 by D. Zhou, R.A. Abd-Alhameed, C.H. See and P.S. Excell published in IET Microwaves, Antennas & Propagation.

* cited by examiner

*Primary Examiner* — Daniel D Chang

(57) ABSTRACT

An antenna module having a side-edge balance-to-unbalance (BALUN). The antenna module may include a flexible substrate with one or more layers that may be configured to receive one first and second conductive patterns, the substrate may have opposed first and second ends which may define a longitudinal length and/or opposed side edges situated between the first and second ends. The first conductive pattern may form an antenna loop situated adjacent to the first end of the flexible substrate and be suitable for transmitting or receiving signals at one or more frequencies. The second conductive pattern may form at least part of the BALUN and may include one or more of a center portion, side portions which may extend from the center portion at opposite sides of the center portion, and electrically neutral slots situated between a corresponding side portion and the center portion.

6 Claims, 16 Drawing Sheets

EMBEDDED PRINTED EDGE-BALUN ANTENNA SYSTEM AND METHOD OF OPERATION THEREOF

FIELD OF THE PRESENT SYSTEM

The present system relates to an antenna apparatus and a mobile station (MS) which include the antenna apparatus and, more particularly, to an antenna apparatus to suppress undesirable currents in a mobile environment and a MS configured to operate with the antenna apparatus.

BACKGROUND OF THE PRESENT SYSTEM

Recently, mobile stations (MSs) such as mobile phones, personal digital assistants (PDAs), IPADs™, IPhones™, laptop computers, netbook computers, Blackberries, and the like have begun to support multiple transmission methods, techniques, systems, components, protocols and/or technologies (hereinafter each of which will be referred to as "protocol" unless the context indicates otherwise) such as 802.11-x, Bluetooth™, WiFi™, WiMax™, and the like, for communication. However, as different communication protocols can require an antenna which is unique to an operating frequency band of a corresponding protocol, MSs must typically incorporate a plurality of antennas to support multiple communication protocols. For example, recently MSs have begun to incorporate a high-frequency radio frequency identification (HF-RFID) communication protocol which requires an internal HF-RFID reader for applications such as proximity payment, ticketing, consumer applications, identity-management and device-to-device (e.g., peer-to-peer) communication. However, as the HF-RFID reader may operate in one or more frequency bands which are not typically supported by conventional MSs (e.g., using code division multiple access (CDMA), global system for mobile communications (GSM), etc.), the HF-RFID reader requires the MSs to incorporate an HF-RFID antenna unique to the operating frequency band or bands of the HF-RFID reader. Unfortunately, space for additional antennas is limited in MSs and antennas must be placed in close proximity with one another. However, because of packaging concerns, radio frequency (RF) cross talk (coupling), coexistence modes, and/or other known issues between antennas (e.g., WiFi and Bluetooth™ antennas), it is difficult to efficiently package transmission systems (e.g., antennas, etc.) for a plurality of communication technologies in an MS while reducing or preventing interference between the various transmission protocols employed by the MS. For example, with regard to WiFi™, and Bluetooth™ protocols, when internal antennas supporting these protocols are placed in proximity with each other, they may suffer from various interference (coupling) such as interference due to, for example, a surface current distribution (Js) on a ground plane on a printed circuit board (PCB) of an MS that may be shared by multiple antennas.

SUMMARY OF THE PRESENT SYSTEM

In accordance with an aspect of the present system, there is disclosed an antenna apparatus for a mobile station (MS).

The antenna system may include a flexible substrate portion which has one or more layers and first and second ends which define a longitudinal length thereof. The substrate portion may include a first portion situated adjacent to the first end and a second portion situated adjacent to the second end. A first conductive pattern configured to transmit or receive radio frequency (RF) signals may be disposed on one or more of the one or more flexible layers of the substrate portion in the first portion of the substrate portion. Further, a second conductive pattern configured to be coupled to one or more of a ground plane of the MS may be disposed on one or more of the one or more flexible layers of the first portion of the substrate portion in the second portion of the substrate portion. The second conductive pattern may be configured to form a side-edge (SE) balance-to-unbalance (BALUN) which controls impedance in the second conductive pattern.

According to the system, the second conductive pattern may include a center portion which extends along a longitudinal length of the substrate and side portions located on opposite sides of the center portion. The system may also include slots which have a length that is approximately equal to $\lambda/4$, where $\lambda$ is the wavelength of a band of the RF signals corresponding with an operating frequency band of an adjacent antenna (e.g., one or more other antennas of the MS which may be coupled to the ground plane of the MS).

The system may further include a control portion that may be configured to process signals received from the first conductive pattern or process signals for transmission by the first conductive pattern. According to the system, the first conductive pattern may include a loop antenna pattern. Moreover, the substrate of the system may include one or more folds situated between the first and second ends of the substrate so as to change (e.g., decrease) an operating frequency band of the antenna system. Further, the system may include a connector portion to couple the second conductive pattern to the ground plane of the MS.

In accordance with a further aspect of the present system, there is disclosed a method of forming an antenna system for a mobile station (MS). The method may include one or more acts of: forming a flexible substrate portion including one or more layers and having first and second ends defining a longitudinal length and including first and second portions situated adjacent to the first and second ends, respectively; forming a first conductive pattern configured to transmit or receive radio frequency (RF) signals and disposed on one or more of the one or more flexible layers of the first portion of the substrate portion in the first portion of the substrate portion; and forming a second conductive pattern configured to be coupled to one or more of a ground plane of the MS and disposed on one or more of the one or more flexible layers of the first portion of the substrate portion in the second portion of the substrate portion, the second conductive pattern being further configured to form a side-edge (SE) balance-to-unbalance (BALUN) which controls impedance in the second conductive pattern.

According to the method, the act of forming the second conductive pattern may include acts of forming a center portion extending along a longitudinal length of the substrate; and forming side portions located on opposite sides of center portion; and/or forming slots on either side of the center portion each slot separating a corresponding side portion from the center portion and having an end wall.

Further, it is envisioned that the method may include an act of setting a length of one or more of the slots to approximately $\lambda/4$, where $\lambda$ is the wavelength of a band of the RF signals corresponding with an operating frequency band of an antenna of the MS (e.g., WiFi: 802.11g/b/a, 2.4-2.483 GHz and 5.15-5.825 GHz; BT, etc.).

Moreover, the method may include an act of forming a control portion configured to process signals received from the first conductive pattern or process signals for transmission by the first conductive pattern. Further, the act of forming the first conductive pattern may include an act of forming a loop antenna pattern. Moreover, it is envisioned that the method may include an act of folding the substrate at one or more locations between the first and second ends of the substrate so as to change (e.g., decrease) an operating frequency band of the antenna system. It is further envisioned that the method may include an act of attaching a connector portion configured to couple the second conductive pattern to the ground plane of the MS.

In accordance with a further aspect of the present system, there is disclosed an antenna module system having a side-edge balance-to-unbalance (BALUN). The antenna module system may include a flexible substrate which has one or more layers and may be configured to receive first and second conductive patterns. The flexible substrate may have first and second ends which define a longitudinal length and opposed side edges between the first and second ends. The first conductive pattern may forms an antenna loop situated adjacent to the first end of the flexible substrate, and may be configured to transmit or receive radio frequency (RF) signals. It is further envisioned that the antenna module system may include a second conductive pattern which forms at least part of the BALUN and has a center portion, side portions extending from the center portion and located on opposite sides of the center portion, and electrically neutral slots situated between a corresponding side portion and the center portion. The second conductive portion may be configured to form an electrical ground for the antenna module.

The antenna module system may include a control portion situated between the first conductive pattern and the second end of the substrate and may include at least one active circuit portion such as a processor and may be configured to process signals for transmission by the antenna or process signals received from the antenna. It is also envisioned that the each side portion of the side portions extends along a portion of an adjacent side edge of the opposed side edges of the substrate. Moreover, the antenna module may include one or more folds located between the first and second ends of the substrate. The substrate may include an opening in the substrate situated within an area situated within a loop of the antenna loop.

Further, it is envisioned that a length of one or more of the center portion, side portions, and electrically neutral slots may be adjusted to change a conductance of the center portion in one or more locations.

BRIEF DESCRIPTION OF THE DRAWINGS

The invention is explained in further detail, and by way of example, with reference to the accompanying drawings wherein.

DETAILED DESCRIPTION OF THE PRESENT SYSTEM

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well known devices, circuits, tools, techniques and methods are omitted so as not to obscure the description of the present system. It should be expressly understood that the drawings are included for illustrative purposes and do not represent the scope of the present system. In the accompanying drawings, like reference numbers in different drawings may designate similar elements.

For purposes of simplifying a description of the present system, the terms "operatively coupled", "coupled" and formatives thereof as utilized herein refer to a connection between devices and/or portions thereof that enables operation in accordance with the present system. For example, an operative coupling may include one or more of a wired connection and/or a wireless connection between two or more devices that enables a one and/or two-way communication path and/or a current path between the devices and/or portions thereof. For example, an operative coupling may include a wired and/or a wireless coupling to enable communication between a circuit board and an antenna. Further, for the sake of clarity, the term system may refer to a system, an apparatus, a method, a computer program, and/or a process of the present system unless the context indicates otherwise.

Figure 1:
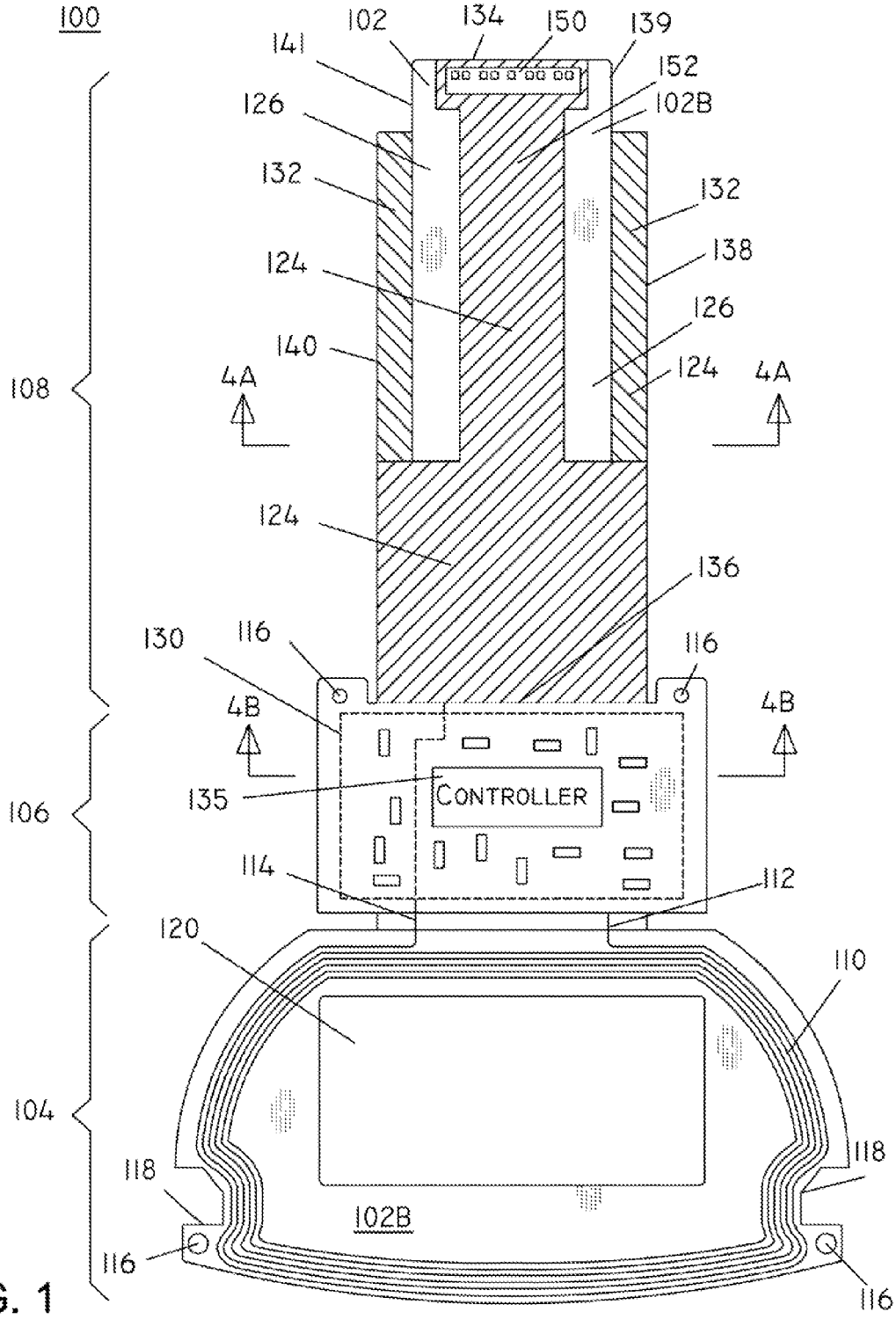
FIG. 1 is a top view of an antenna module of an MS in accordance with embodiments of the present system.

FIG. 1 is a top view of an antenna module 100 of an MS in accordance with embodiments of the present system. The antenna module 100 may include one or more of a substrate 102, an antenna portion 104, a layout portion 106, a tail portion 108. For the sake of clarity, it will be assumed that the antenna and tail portions 104 and 108, respectively, may be radio frequency (RF) passive and the layout portion 106 may be RF active.

The substrate portion 102 may include any suitable flexible material upon which one or more printed circuits may be formed such as, for example, a flexible printed circuit (FPC). Accordingly, the substrate portion 102 may be formed from, for example, one or more dielectric materials such as, a polymer film (e.g., Polymide (PI), Polyester (PET), Polyethylene Napthalate (PEN), etc.) and may include one or more major surfaces such as a first major surface (e.g., see, 102A FIG. 2) and a second major surface 102B. The substrate portion 102 may include one or more mounting portions such as, for example openings 116, notches 118, vias, etc. which may be used to attach the substrate portion 102 in a desired position (e.g., relative to portions of the MS) and/or to attach circuit elements as will be discussed below to the substrate portion 102.

The substrate portion 102 may include one or more layers which may be laminated upon each other. However, for the sake of clarity, in the present example, it will be assumed that the substrate portion 102 may include a single flexible dielectric layer. The substrate layer 102 may also include one or more vias which may be used to mount and/or electrically couple circuit portions (e.g., passive or active circuit portions) and/or traces (e.g., system couplings) to each other.

The substrate layer 102 may include one or more electrically conductive portions and/or electrically isolating portions. The electrically conductive portions and/or the electrically isolating portions (e.g., slots 126 as will be discussed below) may include one or more desired patterns which may be formed using any suitable method. With regard to electrical conductive areas such as traces, these areas may be formed using a conductive material which may be laminated, attached to, and/or formed upon (one or more surfaces or layers) the substrate layer 102 using any suitable method (e.g., solder deposition, vapor deposition, immersion deposition, wire bonding, plating, sputtering, etc.).

The substrate portion 102 may include reinforcing areas which may include one or more stiffening layers (including one or more layers) which may act to increase the rigidity of the substrate layer in one or more portions thereof. For example, a printed circuit board, such as a glass reinforced epoxy laminate sheet, tube, rod, printed circuit board, etc., (e.g., PCB such as an FR4 board, etc.) may be attached to the substrate layer 102 in one or more desired areas so as to increase the rigidity of the substrate layer 102 in the desired area. Additionally, the stiffening layers may include electrically conductive portions (e.g., traces) active and/or inactive components (e.g., processors, resistors, etc.), which may form desired circuits and/or portions thereof.

The substrate layer 102 may include an electrical ground pattern (EGP) which may be electrically coupled to a ground plane of the MS via, for example, a connector as will be discussed below. The antenna portion 104 may include any suitable antenna or elements and may have a desired pattern. For example, the antenna may include a printed coil antenna 110 which may include one or more patterns formed from a conductive material having a trace which defines one or more loops and may have one or more end leads 112 and 114, one of which may be electrically coupled to the EGP of the substrate 102 via, for example, a conductive portion 124 as will be discussed below. The antenna may be printed or otherwise formed upon a major surface or surfaces (e.g., 102B) of the substrate portion 102 using any suitable method. For example, the printed coil antenna 110 may be formed upon the second major surface 102B of the substrate 102 using deposition techniques, etc. However, it is also envisioned that the antenna may be pre-formed from a conductive material and then attached to the substrate 102 using, for example, an adhesive, etc. The antenna may include a shape and size which may be dependent upon a desired operating frequency, frequency range, and/or power level of the antenna.

The antenna portion 104 may include a center opening 120 which may be used to provide a passage for an optical scanner such as a Block-BUSTER 2-Dimensions/Block-Buster 1-Dimensions™ BB/BCR optical scanner.

The layout portion 106 may include circuitry (e.g., traces, etc.) which is coupled to one or more of the end leads of the antenna portion 104 such as, for example, end leads 112 and/or 114 and may be operative to receive RF signals from the antenna portion 104, and/or send signals for transmission to the antenna portion 104. Accordingly, the layout portion 106 may include control circuitry 130 which may process signals for transmission by the antenna portion 104 and/or process signals received from the antenna portion 104 so as to perform a wireless communication function which can transmit and/or receive information. The control circuitry 130 may include one or more process portions 135 such as processors, controllers, application specific integrated circuits (ASICs), logic devices, etc., which may process signals in accordance with one or more communication protocols, techniques, methods, etc. (hereinafter each of which will be referred to as protocols unless the context indicates otherwise as discussed above). Accordingly, the control circuitry 130 may further include analog-to-digital (A/D) and/or digital-to-analog (DA) portions, analog and/or digital baseband portions, amplifiers, filters, encoders, decoders, equalizers/demodulators, etc., to perform communication functions. In the present example, the control circuitry 130 may be operative to communicate by transmitting and/or receiving information (e.g., voice, data, content, etc.) using one or more frequency ranges (e.g., including frequency bands of one or more wireless communication channels). Accordingly, the control circuitry 130 may be operative in accordance with one or more communication protocols such as an HF-RFID protocol operative at a transmission/reception (Tx/Rx) frequency range, for example, 13.56 MHz for a loop antenna of an HF-RFID reader. Accordingly, the a Tx/Rx wavelength may be a wavelength of $\lambda_{TxRx}$ which may be different from $\lambda$ which may correspond with an operating frequency (or multiples thereof) of another antenna of the MS. However, other protocols and/or frequency ranges are also envisioned. The layout portion 106 may include an electrical ground which may be coupled to or form part of the EGP of the substrate layer 102.

The tail portion 108 may include one or more of first and second ends 134 and 136, respectively, first and second major side edges 138 and 140, respectively, first and second minor side edges 139 and 141, respectively, one or more slots 126, the conductive portion 124 (which is cross hatched for the sake of clarity), side portions 132 (which is cross hatched for the sake of clarity), and a connector (portion) 150, one or more of which may be operative as a side edge BALUN which may control impedance (e.g., to increase or decrease impedance) of the conductive portion 124 in one or more locations or areas. Accordingly, a flow of a surface current in the conductive portion 124 may be controlled at one or more frequencies.

The conductive portion 124 may be shaped and sized such that it extends along a longitudinal length of the tail portion 108 between the first and second ends 134 and 136 of the tail portion 108 and may have a varying width. For example, with reference to FIG. 1, the width of the conductive portion 124 may be wider at an area (e.g., a base) of the conductive portion that is adjacent to the second end 136 of the tail portion 108 and at an area (e.g., a top) that is adjacent to the first end 134 of the tail portion 108. Between these areas, the conductive portion 124 may have a width that it defined by first and second slots 126. Accordingly, the conductive portion 124 may form an "l" shaped conductor in these areas. The conductive portion 124 may form at least part of the EGP of the substrate 102.

The side portions 132 may extend from a base of the "l" shaped conductor along a longitudinal length of the tail portion 108 such that it is situated between a corresponding slot and a corresponding major side edge 138 or 140 of the tail portion 108. The side portions 132 may be formed from a conductive material and may have a desired length and/or width as described herein. Each of the slots 126 may be situated between portions of the conductive portion 124 and a corresponding side portion 132. Accordingly, the slots 126 may have a desired shape and size and may define a substantially electrically non-conductive area and/or areas cut from the substrate portion 102.

Thus, for example, to reduce or entirely prevent interference (e.g., due to RF cross talk, such as groundcoupling), etc.) with an antenna of the MS which is coupled to the ground plane of the MS and which operates in, for example, an 802.11-x (e.g., a/b/g/n), BT, or WiFi frequency range (e.g., with a corresponding wavelength $\lambda$ of about 2.4-2.483, 5.15-5.825 GHz, etc.), dimensions of the slots, such as a length of the slots, may be adjusted to be substantially equal to $\lambda/4$ in freespace, although as may be readily appreciated by a person of ordinary skill in the art, in a MS, the length of the slots may be about 90%, 95%, etc., of the freespace to account for transmission line dimensions, etc. However, $\lambda$ may be different from a transmission/reception (Tx/Rx) wavelength $\lambda_{TxRx}$ which corresponds with an operating frequency band of the antenna portion (e.g., for transmission or reception) of the present antenna system. As used herein, $\lambda$ represents a center frequency of a transmission/reception band (e.g., 2.4-2.483, 5.15-5.825 GHz, etc.) of a given one of the antennas of the MS.

The conductive portion 124 and/or the side portions 132 may include one or more layers which may be formed using any suitable method (e.g., vapor deposition, etching, soldering, lamination, etc.), may include any suitable conducting material (e.g., copper, silver, gold, nickel, tin, etc.) and may be situated upon a surface of the substrate such as the second side 102B of the substrate 102. The conductive portion 124 may be electrically coupled at or near an end which is adjacent to the first end 134 of the tail portion 108 to a ground plane of the MS using any suitable method. For example, the conductive portion 124 may be coupled to the ground plane of the MS via the connector 150. However it is also envisioned that the conductive portion 124 may be coupled to the ground plane of the MS using any other suitable method such as, for example, adhesives (e.g., conductive adhesives), soldering, friction fitting, etc.

Figure 2:
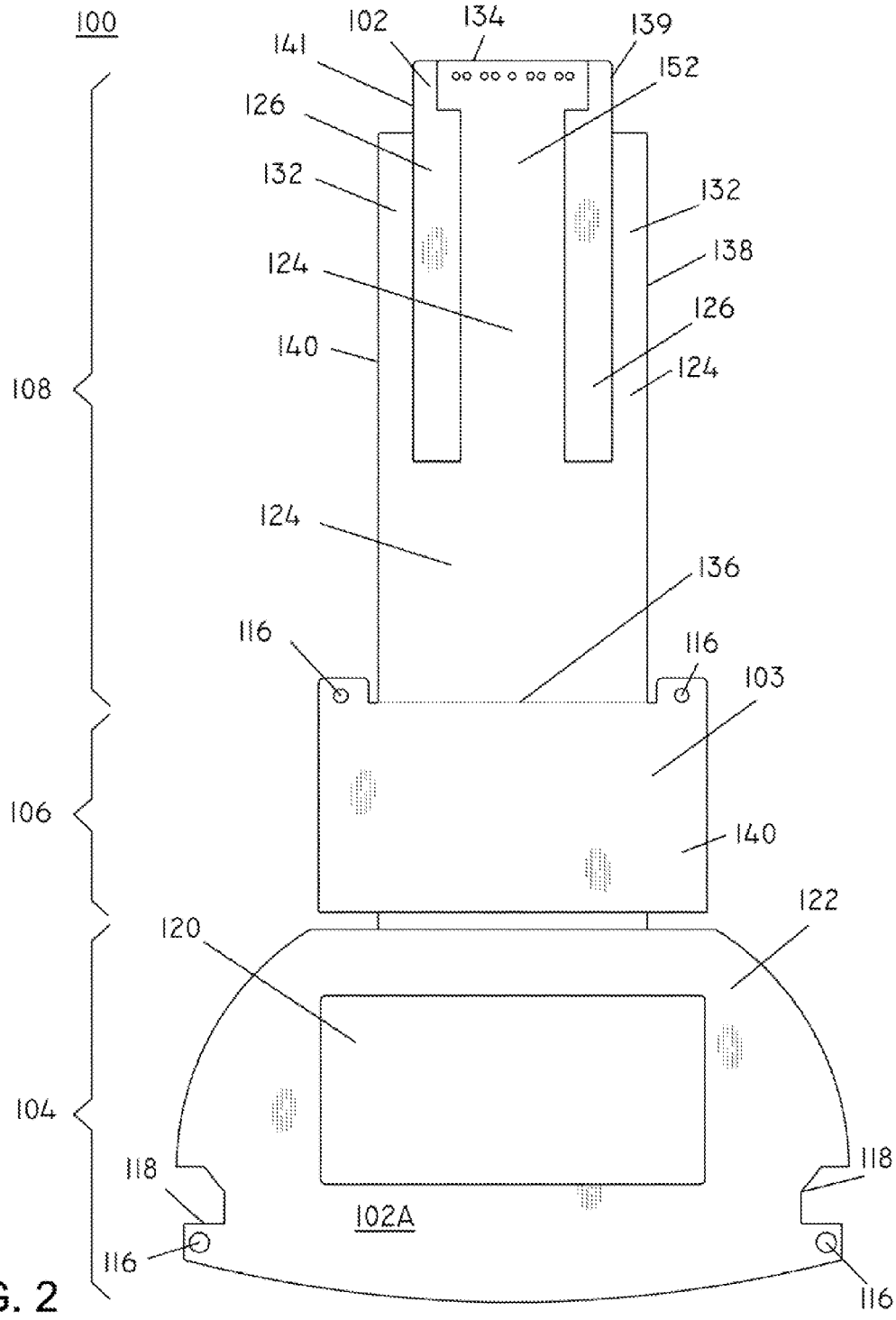
FIG. 2 is a bottom view of the antenna module of the MS in accordance with embodiments of the present system.

FIG. 2 is a bottom view of the antenna module 100 of the MS in accordance with embodiments of the present system. For example a portion of the antenna module 100 may be a ferrite portion 122 formed from a ferrous material that may be situated upon the first side 102A of the substrate portion 102. The ferrite portion 122 may act as a shield to reduce or entirely prevent the generation of eddy currents in nearby conductors such as traces in the PCB board of the MS or other metallic surfaces (e.g., battery casing, etc.) due to fields (e.g., an H-field) of the of the coil antenna 110. Accordingly, the ferrite portion 122 may be placed on a side of the substrate portion 102 between the coil antenna 110 and the other metallic surfaces so as not to impede the transmission and/or reception functions of the antenna. The ferrite portion 122 for example may have a permeability of about $\mu$=35. However, other permeability values or ranges are also envisioned. The opening 120 may have one or more walls and may extend through the substrate 102 and the ferrite portion 122.

Figure 3:
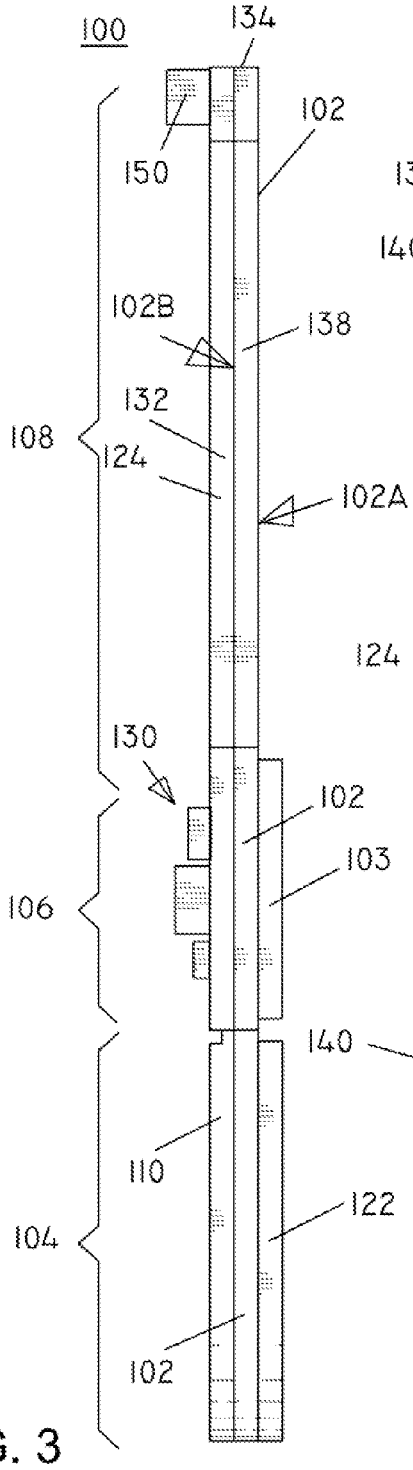
FIG. 3 is a side view of the antenna module of the MS in accordance with embodiments of the present system.

FIG. 3 is a side view of the antenna module 100 of the MS in accordance with embodiments of the present system. The connector 150 may include one or more leads which are electrically coupled to conductive portion 124 so as to be electrically coupled to the EGP. Illustratively, a reinforcing substrate is 103 attached to the substrate 102 in the layout portion 106 of the antenna module 100. The reinforcing substrate 103 may be formed from any suitable material such as, for example, a printed circuit board material (e.g., FR4, etc.) and may be shaped and sized similarly to the layout portion 106 so as to increase the rigidity of the layout portion 106. The reinforcing substrate 103 may be attached any surface of the substrate 102 such as the second major surface 102B of the substrate 102.

Figure 4A:
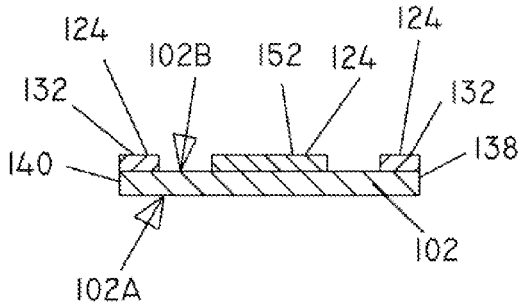
FIG. 4A is a cross sectional view of the antenna module taken along lines 4A-4A of FIG. 1 in accordance with embodiments of the present system.

FIG. 4A is a cross sectional view of the antenna module 100 taken along lines 4A-4A of FIG. 1 in accordance with embodiments of the present system. The conductive portion 124 may include a pattern including a center portion 152 that is separated from adjacent side portions 132 by corresponding electrically neutral slots 126 (e.g., non-conductive) which may extend along a longitudinal length of the tail portion so as to separate the center portion 152 from the adjacent side portions 132 along a substantial length of the side portions 132. The slots 126 may be defined by one or more electrically neutral areas or openings in or on the substrate 102.

Figure 4B:
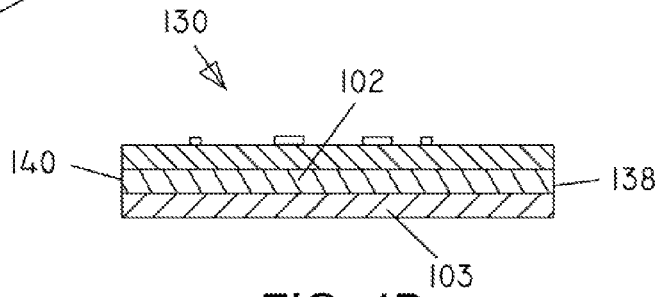
FIG. 4B is a cross sectional view of the antenna module taken along lines 4B-4B of FIG. 1 in accordance with embodiments of the present system.

FIG. 4B is a cross sectional view of the antenna module 100 taken along lines 4B-4B of FIG. 1 in accordance with embodiments of the present system. As illustratively shown, the reinforcing substrate 103 may be attached to the substrate portion 102 to increase the rigidity of the layout portion 106 and prevent flexing in one or more desired areas of the substrate portion 102.

Figure 5A:
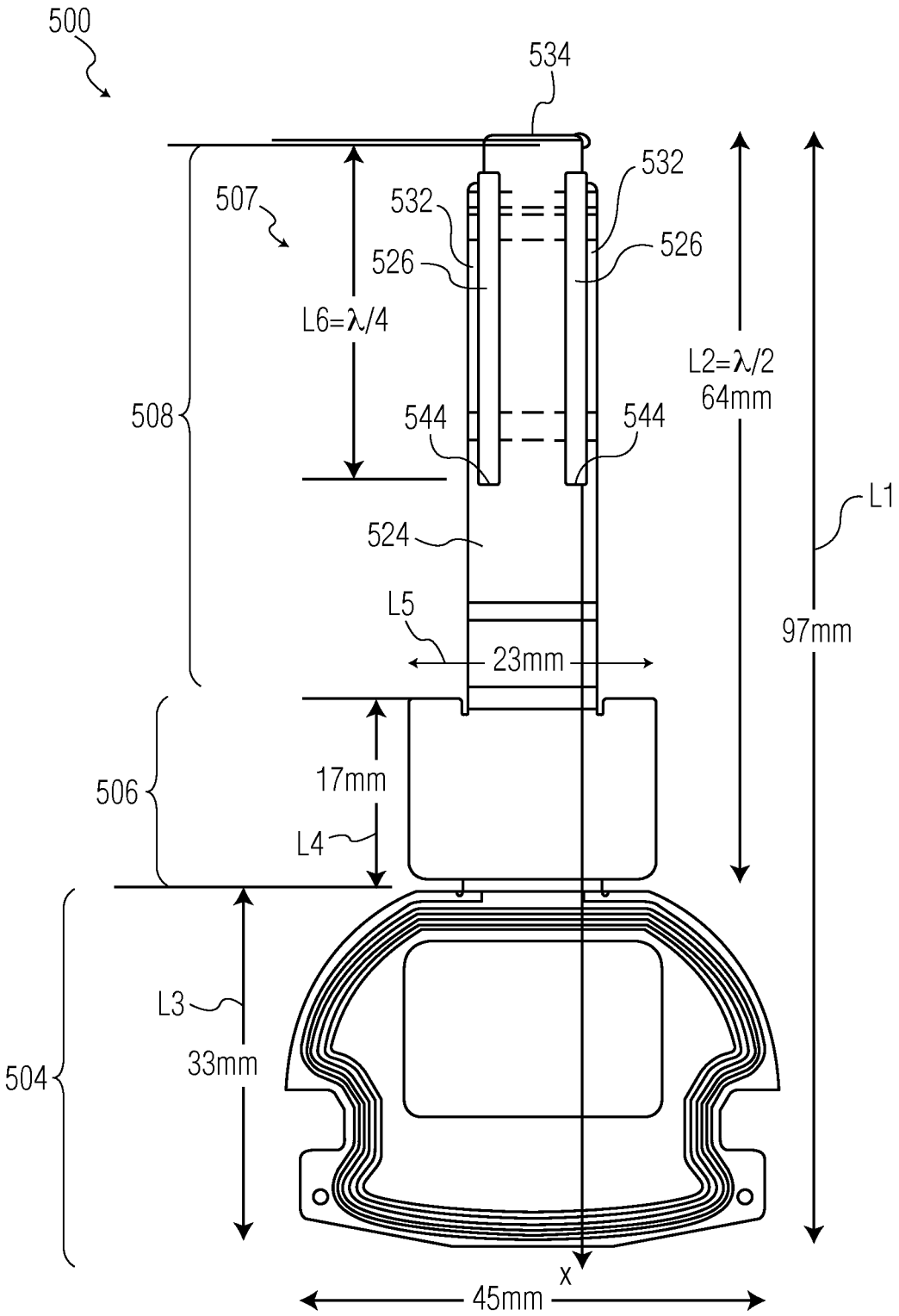
FIG. 5A is a top view of an antenna module of an MS in accordance with embodiments of the present system.

FIG. 5A is a top view of an antenna module 500 of an MS in accordance with embodiments of the present system. The antenna module 500 is essentially similar to the antenna module 100 and indicates exemplary dimensions for an antenna module having a transmission/reception wavelength of $\lambda_{TxRx}$ which may inversely correspond with a TxRx frequency range of an antennas emission/reception wavelength. In the present example, the antenna module 500 operates as a HF-RFID antenna with an Tx/Rx frequency band of about 13.56 MHz and a corresponding wavelength of $\lambda_{TxRx}$. A combined length of a tail portion 508 (which may include an edge BALUN portion 507) and a layout portion 506 as indicated by L2 may be equal to $\lambda/2$ or multiples of thereof (e.g., $n*\lambda/2$ where n=1, 2, 3, . . . , N, e.g., resonance frequencies) so that a desired conductance of the tail 508 may be obtained so as to reduce interference with other antennas of the MS which operate at frequency range which has a corresponding wavelength of $\lambda$ which may differ from $\lambda_{TxRx}$. As may be readily appreciated by a person of ordinary skill in the art, the length of portions of the present antenna system that are described herein expressed in harmonic/resonant frequencies of an antenna emission/reception wavelength, may be readily fabricated for other harmonic/resonant frequencies in accordance with embodiments of the present system including variations from the harmonic/resonant frequencies. However, variations (e.g., +/−5%) from harmonic/resonant frequencies in determining the lengths, may degrade performance of the present antenna system though may be implemented based on other design considerations as may be readily appreciated. Accordingly, a given illustrative length is not intended to limit the scope of the present system unless expressed otherwise in the context that follows including the claims contained herein.

Figure 5B:
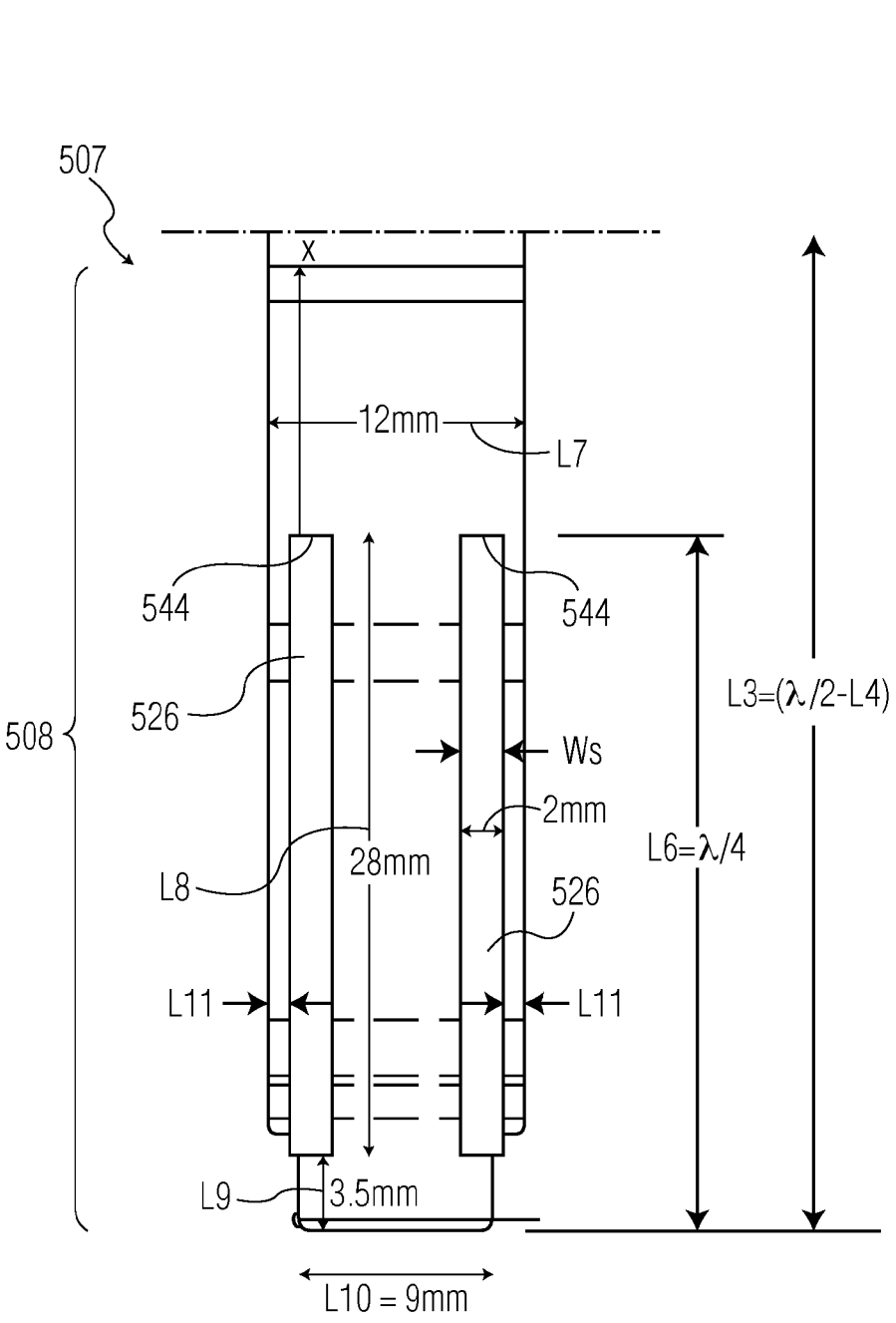
FIG. 5B is a detailed top view of an edge ballast portion of the antenna module in accordance with embodiments of the present system.

Further, a length L6 which corresponds with an approximate length from an edge 534 of conductive portion 524 to an end 544 of a slot 526 in embodiments of the present system may be substantially equal to λ/4 so that a desired conductance of the tail portion 508 may be obtained. With regard to lengths L1, and L3-L5, exemplary dimensions are shown for illustration and may be set in accordance with design considerations. Exemplary dimensions of the edge BALUN portion 507 are described below with reference to FIG. 5B which is a detailed top view of an edge ballast portion 507 of the antenna module 500 in accordance with embodiments of the present system. Slots 526 illustratively may have a width Ws of about 2 mm. Lengths L7 through L11 are shown for exemplary purposes and may change based upon design considerations. However, it is envisioned that according to an embodiment of the present system, L7 may be about 12 mm, L8 may be about 28 mm, L9 may be about 3.5 mm, L10 may be about 9 mm, and L11 may be about 1 mm. The BALUN 507 may operate in accordance with Quasi-transverse electromagnetic (Quasi-TEM) modes as is known in the art. With regard to the lengths L2 and L6, by setting these lengths to about λ/2 and λ/4, respectively, the flow of Js (e.g., from the ground plane (GP) of an PCB board of an MS to which the tail portion 508 is coupled) can entirely or substantially be blocked and/or a flow of a surface current along a longitudinal length of the tail portion 508 may also be entirely or substantially blocked for a predetermined frequency or frequency range (e.g., a frequency inversely proportional to λ). Further, L6 may be equal to the sum of lengths L8 and L9. Thus, the printed edge BALUN of the present system may effectively suppress surface current distribution generated from an external source such as, for example, a WiFi or Bluetooth source (e.g., source 3 discussed below). Accordingly, the printed edge BALUN of the present system may block a surface current which may flow from the tail portion and may interfere with other sources (e.g., see, source 1 and 2 discussed below), such as provided by an ISM band antenna (e.g., 2.4 GHz, etc.). By reducing the flow of Js along the tail portion, cross interference may be reduced or entirely eliminated thus the FPC of the present system may be considered to not effectively appear from an RF point of view at an ISM band.

Although dimensions for the antenna module 500 may correspond with an antenna module operating in a 2.4 GHz band, it is also envisioned that other frequencies and/or bands may also be utilized in accordance with embodiments of the present system.

Figures 6A, 6B, 7A, 7B:
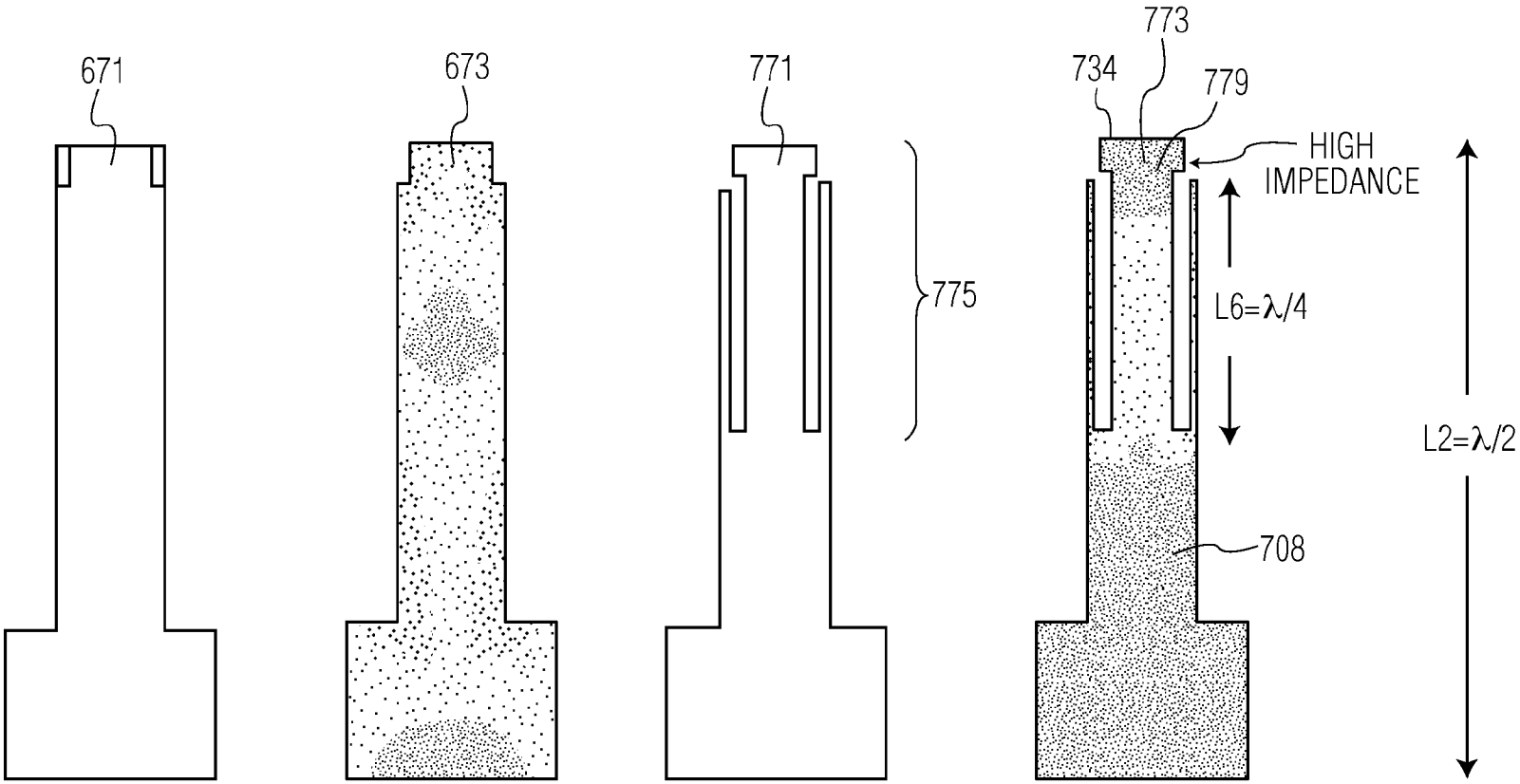
FIG. 6 shows graphs of tail portions and corresponding surface current distributions.
FIG. 7 shows graphs of tail portions and corresponding surface current distributions.
Figure 8:
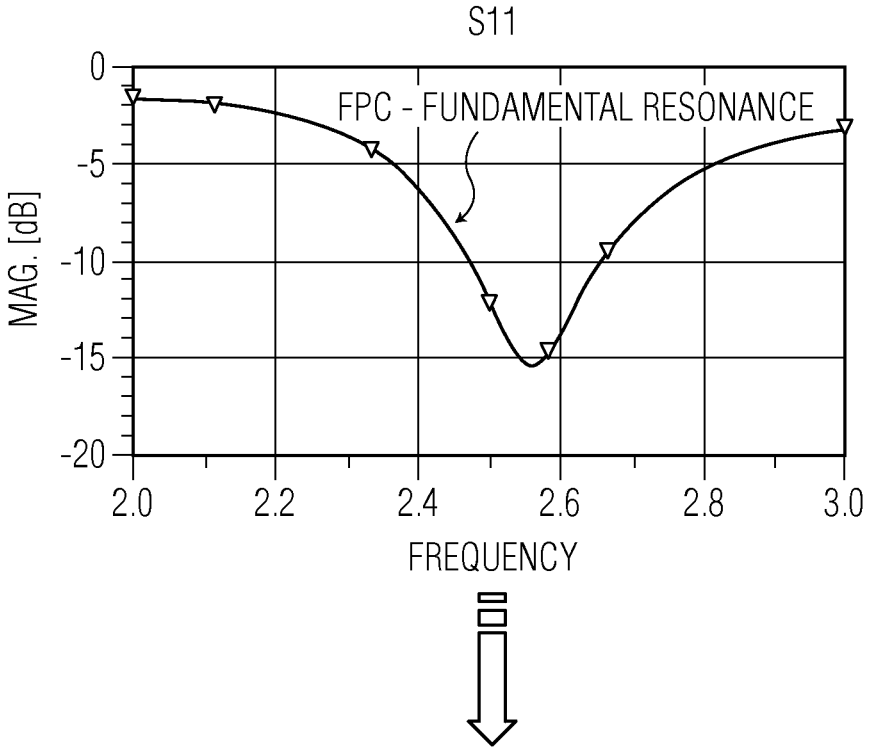
FIG. 8 shows a graph indicating a return loss (S11) of a tail portion without a side-edge BALUN as a function of frequency.

With reference to FIGS. 6 through 8, these figures illustrate theoretical results for various FPC antenna modules at a 2.437 GHz frequency band (and thus a corresponding value of λ).

FIGS. 6 and 7 show graphs of tail portions and corresponding surface current distributions. With respect to FIG. 6, the graph shows an outline of an electrical ground pattern 671 of a tail portion without a side edge BALUN of the present system and graph B shows a corresponding surface current distribution 673. Darker shading indicates areas of higher impedance. The surface current distribution 673 may correspond with a sinusoidal conductance pattern. With respect to FIG. 7, graph A shows an outline of an electrical ground pattern 771 of a tail portion of a substrate which includes a BALUN 775 with dimensions (e.g., slots of length λ/4) in accordance with the present system and a corresponding graph B of a corresponding surface current distribution 773. Darker shading indicates areas of higher impedance. The side-edge BALUN 775 of the present system reduces or entirely prevents the formation of sinusoidal patterns in the electrical ground pattern 771 of the tail portion of the substrate.

With reference to FIGS. 6 and 7, it is seen that the tail portion with the side edge BALUN 775 in accordance with the present system effectively increases impedance in the electrical ground pattern and, thus, reduces a surface current flow into or out of the of tail portion at an end 734 of the tail portion. More specifically, with respect to that region which lies adjacent to a first end 734 of a tail portion 708, the high impedance region (e.g., a cold point) for an antenna module (e.g., an HF-RFID antenna module) minimizes the flow of current into and/or out of the tail portion 708 of the antenna module.

Figure 9:
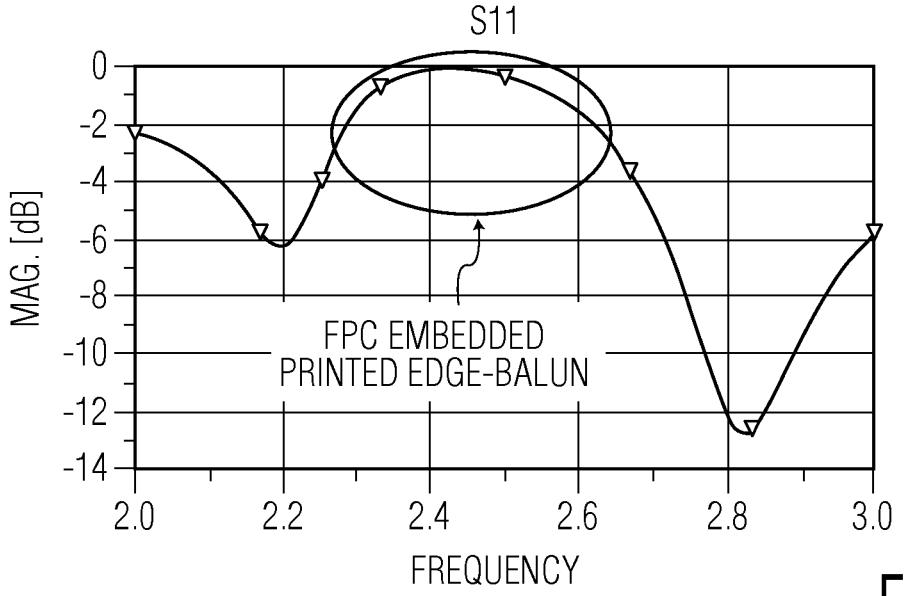
FIG. 9 shows a graph indicating a return loss (S11) of a tail portion with a side-edge BALUN as a function of frequency.

FIGS. 8 and 9 show graphs indicating a return loss (S11) of tail portions without and with a side-edge BALUN, respectively, as a function of frequency. Specifically, FIG. 8 shows a graph of theoretical values for S11 (e.g., a reflection coefficient of the tail portion) as a function of frequency for the antenna shown in graph A of FIG. 6. The return loss (S11) is related to the reflection coefficient of the tail portion in-band of a desired frequency such as a WiFi or BT frequency band (e.g., 2.4-2.483 GHz) corresponding with a transmission frequency of another antenna of an MS. With respect to the tail portion of FIG. 6, its return loss (S11) is indicative of an antenna which would most likely interfere with other antennas of the MS operating at WiFi or BT frequency bands.

FIG. 9 shows a graph of theoretical values for S11 (e.g., a reflection coefficient of the tail portion) as a function of frequency for the antenna shown in graph A of FIG. 7. Note an increase in S11 centered at about 2.4 GHz which is a tuned interference operating frequency of the antenna. However, with reference to the tail portion of FIG. 7 including the side-edge BALUN which causes a high impedance area 779 in-band of a WiFi/BT frequency band (e.g., 2.4-2.483 GHz) and which raises the S11 curve at this frequency range (e.g., see circled area FIG. 9). Accordingly, with the tail portion including the side-edge BALUN in accordance with embodiments of the present system, interfere with other antennas of the MS (e.g., a WiFi/BT frequency band in the present example) is reduced or prevented. As may be readily appreciated by a person of ordinary skill in the art, when you place conductor, such as a grounded stub (e.g., arbitrarily positioned) close to an antenna, there is a coupling effect if the conductive portion includes a length that is matched to a resonant length of the antenna beside it. So, in accordance with embodiments of the present system, an antenna designer may shift from this resonant frequency to prevent an effect to the antenna performance. In accordance with embodiments of the present system, one option is to increase the length of the stub (e.g., the conductive pattern of the tail portion) which results in a shift (e.g., left shift) out of a transmission band of the antenna. In accordance with embodiments of the present system, other design features may be adjusted alone or together with the length of the stud.

Figure 10:
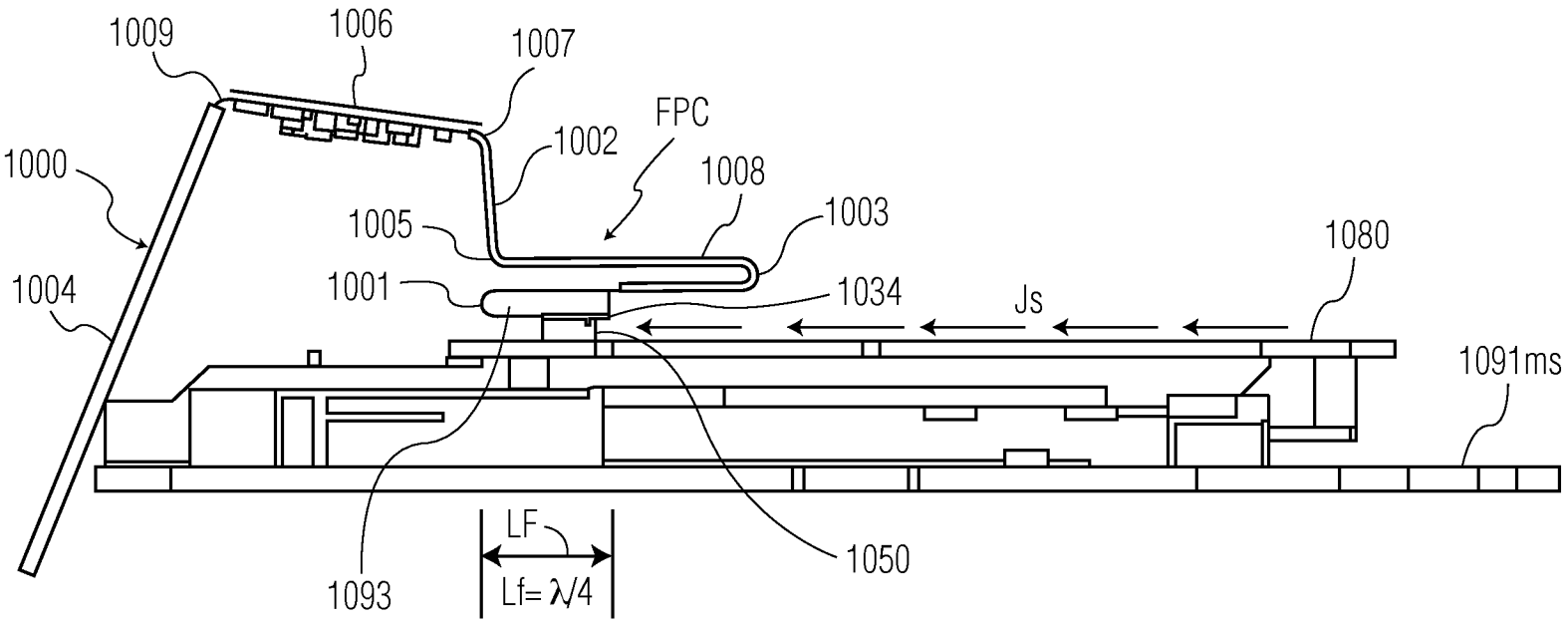
FIG. 10 is a side view of the antenna module of the MS in accordance with embodiments of the present system.

FIG. 10 shows a side view of an antenna module 1000 of an MS in accordance with embodiments of the present system. The antenna module 1000 is similar to the antenna module 100 as shown in FIG. 1 and is shown coupled to a circuit board 1080 of a corresponding MS 1091 via connector 1050. For given operating frequencies of the MS, the antenna module 1000 may be folded at one or more locations and may include a dielectric portion 1093 situated between opposed major surfaces of a substrate 1002 (e.g., separated by a thickness of the dielectric slab, such as a dielectric slab of polycarnonate, ABS, may have dimensions of Lf=8 mm; thickness=2 mm; width=6 mm, although other dimensions may be readily applied based on design considerations).

The dielectric slab may be placed extending from the end 1034 of the antenna module 1000. In accordance with embodiments of the present system, dimensions of the dielectric slab may be adjusted for different operating frequencies of the antennas of the MS. Accordingly, the antenna module 1000 is coupled to a ground plane of the MS 1091 via tail portion 1008 whose side edge BALUN may increase impedance of an electrical ground portion of the antenna module 1000 so as to reduce the flow of a surface current along the electrical ground pattern of the antenna module 1000. Accordingly, the flow of a surface current Js from the circuit board 1080 into the tail portion 1008 may be minimized. Further, by reducing the flow of a surface current along the electrical ground pattern of the antenna module, the antenna module 1000 may minimize its RF view at a band of the antenna (e.g., at a WiFi or an 802.11a band). With regard to the folds, the folds may include one or more of folds 1001, 1003, 1005, 1005, 1009 which may include, for example, one or more full folds (e.g., 1001 and 1003) and/or partial folds (e.g., 1005, 1007, and 1009). The fold 1001 may be situated such that it is located at a distance $L_f$ from the end 1034 of the tail portion 1008 (which, in the present example, is shown to correspond with an end of the substrate layer 1002). To maximize impedance, $L_f$ may be equal to or substantially equal to $\lambda/4$. However, other values of $L_f$ are also envisioned, such as at lengths that correspond to other antenna emission/reception wavelengths and/or harmonic/resonant frequencies thereof. The dielectric portion 1093 may be situated between adjacent surfaces that lie on either side of a fold such as, for example, fold 1001 and may be attached to the substrate 1002 using any suitable method (e.g., an adhesive, a friction fit, a screw, etc.). The dielectric portion 1093 may be formed from any suitable dielectric material (e.g., polycarbonate, ABS plastic).

By folding the substrate 1002 at one or more folds, the operating frequency band of the antenna module 1000 may be increased from an operating frequency band of an antenna of similar dimensions without being folded. Accordingly, by folding the substrate 1002, the antenna module may be operative in a higher frequency band such as, for example, a frequency band from 5.15 to 5.825 GHz which may correspond with the IEEE 802.11a/WiFi protocol.

Accordingly, by folding a substrate of an antenna module in accordance with embodiments of the present system in one or more selected areas, a single antenna module which is tuned to operate at a first frequency band may be optimized for one or more other frequency bands by folding the substrate of the antenna module. Moreover, by placing a dielectric portion between adjacent folded major surfaces of the substrate of the antenna module, impedance of the antenna module, such as the impedance at the tail section, may be increased.

A method to select a contact location (CI) for an antenna feed point for coupling a connector (e.g., 150) of an antenna module of the present system to a PCB board of an MS having other antenna feed points (e.g., two other antennas—i.e., source 1 and source 2) will now be described with reference to FIG. 11.

Figure 11:
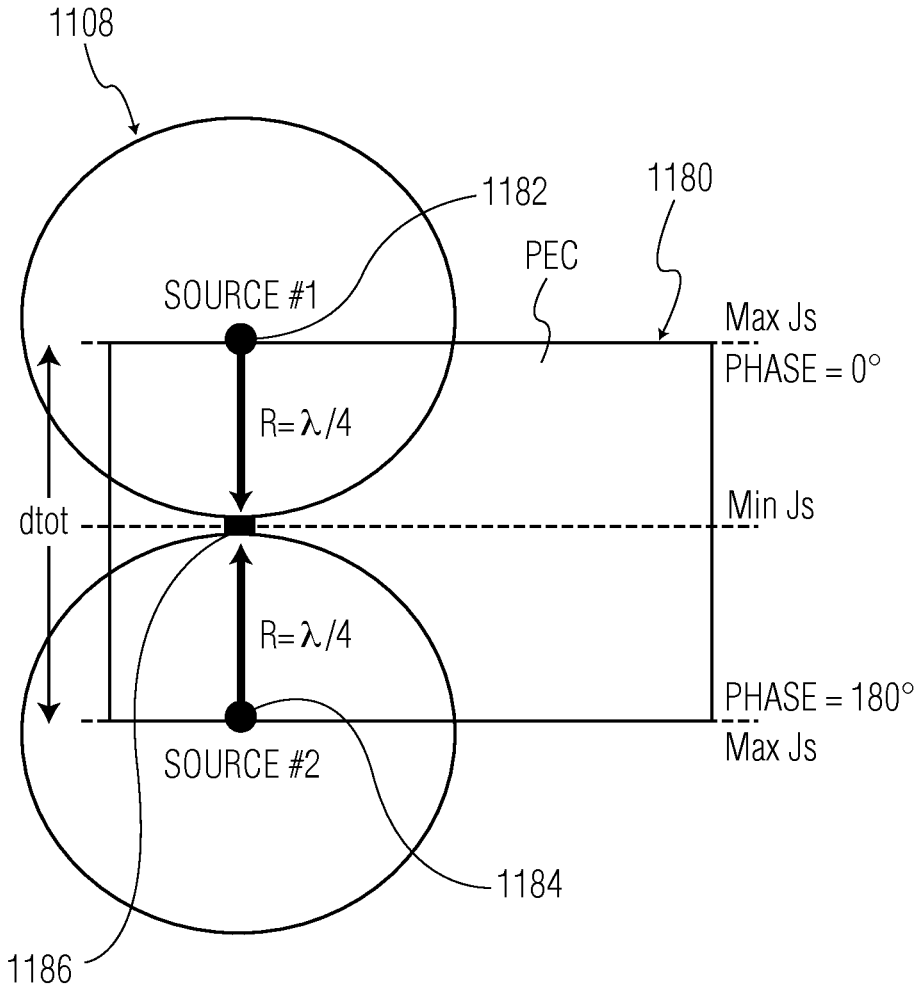
FIG. 11 is a top plan view of spatial relation of antennas of an MS illustrating a connection location of an antenna module in accordance with embodiments of the present system.

FIG. 11 is a top plan view of spatial relation of antennas of an MS 1108 illustrating a connection location of an antenna module in accordance with embodiments of the present system. The MS 1108 may include a circuit board 1180 having a first antenna feed point 1182 (hereinafter a first source or source #1) and a second antenna feed point 1184 (e.g., hereinafter a second source or source #2) which illustratively may be located half a wavelength (e.g., $\lambda/2$) away from each other (e.g., due to design considerations). This distance is represented as $D_{s1s2}$ (shown as dtot) and may correspond with an electrical phase of 180 degrees so as to provide space diversity between the first and second sources.

With respect to frequencies ($f_i$), the first and second sources may operate at frequencies $f_1$ and $f_2$ respectively which have corresponding operating wavelengths $\lambda_1$ and $\lambda_2$. In the above example, $f_1$ at the first source may correspond with a frequency band corresponding with the IEEE 802.11 a/b/g technology (e.g., WiFi, etc) frequency band (or block) operating at 2.4 GHz. Further, illustratively $f_2$ of the second source may correspond with a Bluetooth™ technology frequency band, for example operating at a 2.4 GHz band (e.g. at 2.402-2.480 GHz). A frequency of the antenna module $f_m$ of the present system may operate in a 5 GHz band (e.g. 5.15-5.825 GHz) corresponding with a HF-RFID protocol. However, other frequencies and/or bands are also envisioned. However, for the sake of clarity, as $f_1$ and $f_2$ operate in the same frequency band, $f_1$ and $f_2$ may be represented as f and $\lambda_1$ and $\lambda_2$ may be represented as $\lambda$, for the sake of clarity.

Each of the first and second sources may contribute to a respective surface current distribution Js which may be minimized at distances which are greater than a minimum threshold distance $d_{min}=\lambda/4$ (e.g., a quarter wavelength from the respective source) which may correspond with a radius R centered at a corresponding source. Accordingly, in the present example, as the first and second sources are separated from each other by $D_{s1s2}=\lambda/2$, and $d_{min}=\lambda/4$, CI is located $\lambda_i/4$ from each of the respective first and second sources as shown. This line is illustrated as Min Js. Accordingly, CI may correspond with a location 1186 which has a minimum Js (i.e., cold point) and/or an electrical phase of 90 degrees. Accordingly, the antenna module may be coupled to the circuit board of the MS at location 1186 to minimize the effect of Js from the first and second sources upon the antenna module.

Figure 12:
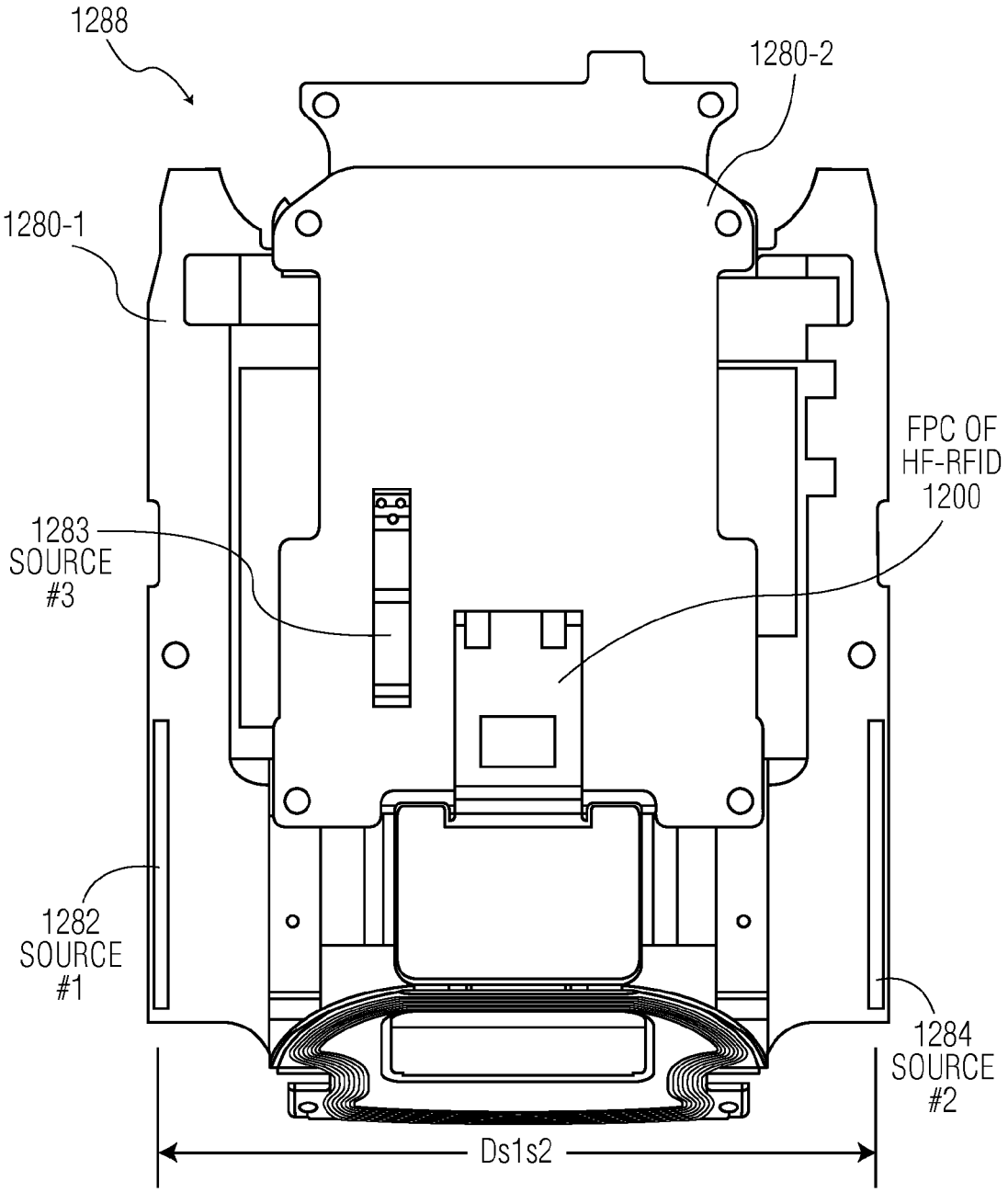
FIG. 12 is a top view of exemplary dimensions for an antenna module of an MS in accordance with embodiments of the present system.
Figure 13A:
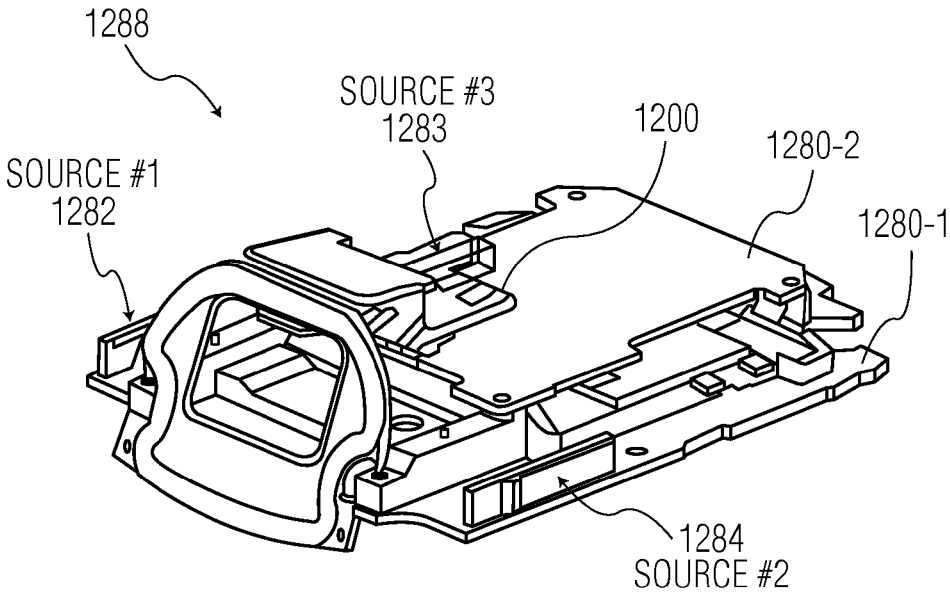
FIG. 13A is a perspective view of a mounting arrangement of the antenna module in the MS of FIG. 12.
Figure 13B:
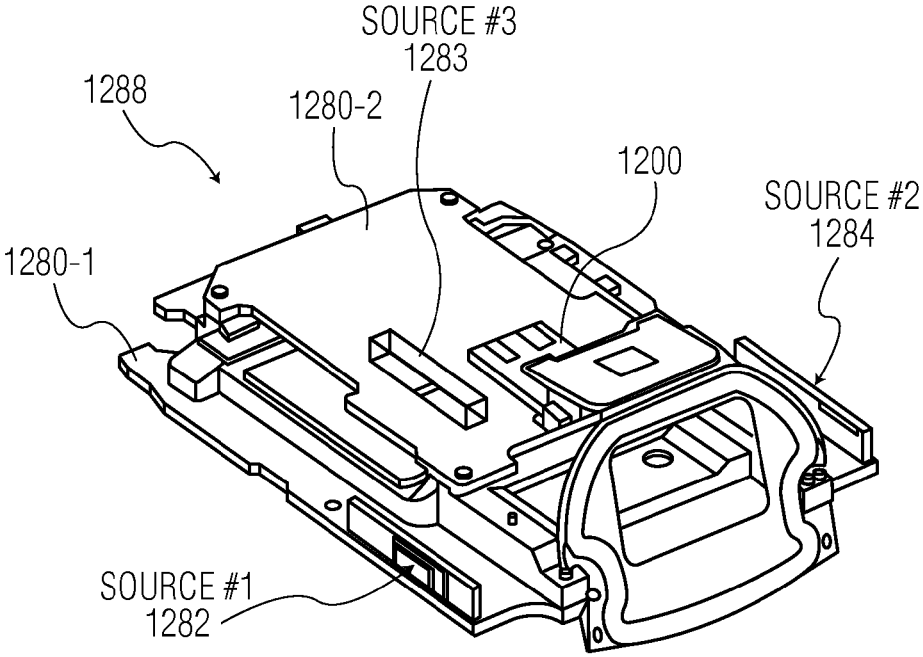
FIG. 13B is a perspective view of a mounting arrangement of the antenna module in the MS of FIG. 12.

FIG. 12 is a top view of an antenna module 1200 of an MS 1288 including exemplary dimensions in accordance with embodiments of the present system. FIGS. 13A and 13B are perspective views of a mounting arrangement of the antenna module 1200 in the MS 1288 of FIG. 12. The antenna module 1200 is mounted in the MS 1288 and may be similar to the antenna module 100. The MS 1288 may include one or more of PCB boards 1280-1 and 1280-2, first through third sources 1282, 1284, and 1283, respectively, (each having a corresponding antenna and antenna feed point) and the antenna module 1200. In accordance with embodiments of the present system, the PCB boards 1280-1 and 1280-2 may share a common ground plane. The first and second sources 1282 and 1284 may be separated by a distance $d_{s1s2}$ and may be mounted to one of the PCB boards such as PCB board 1280-1. The third source 1283 (e.g., a BT antenna) and the antenna module 1200 may be mounted to a PCB board such as PCB board 1280-2. The third source 1283 may be BT antenna and may be separated from the antenna module 1200 (e.g., a connector for the antenna module 1200) by a distance which is less than $\lambda/4$. Accordingly, the tail portion of the antenna module 1200 may include a side-edge BALUN which provides sufficient impedance adjacent to its connector 1283 so as to reduce or entirely prevent coupling between the third source 1283, other sources and the antenna module 1200.

Figure 14:
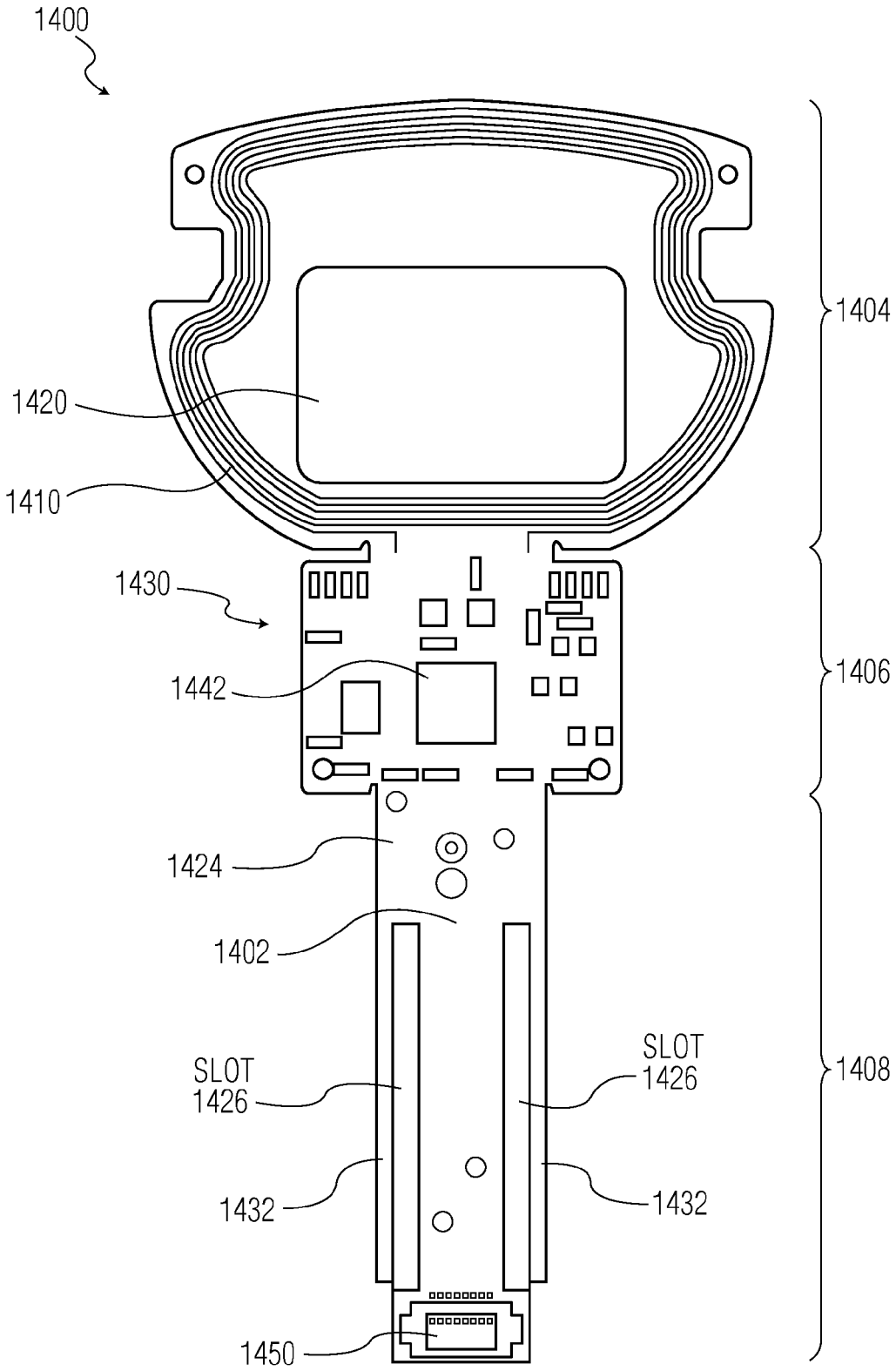
FIG. 14 is a top view of an antenna module of an MS in accordance with embodiments of the present system.

FIG. 14 is a top view of an antenna module 1400 of an MS in accordance with embodiments of the present system. The antenna module 1400 may be similar to the antenna module 100 and may include one or more of a substrate 1402, an antenna portion 1404, a layout portion 1406, and a tail portion 1408. The tail portion 1408 may include one or more of a conductive portion 1424, side portions 1432, slots 1426, and a connector portion 1450. The conductive portion 1424, the side portions 1432, and/or the slots 1426 may be shaped and sized to form a side edge BALUN. Accordingly, the side portions 1432 may be electrically coupled to the conductive portion 1424 and may be electrically isolated from the conductive portion 1424 by the slots 1426. The connector portion 1450 may couple the conductive portion 1426 to a ground of the MS.

The layout portion 1406 may include control circuitry 1430 which may control the overall operation of the antenna module 1400. The control circuitry 1430 may include passive and/or active circuits. With regard to the active circuits, these may include one or more process portions 1442 such as processors, controllers, processors, application specific integrated circuits (ASICs), etc., to process signals received or transmitted in accordance one or more desired protocols.

The antenna portion 1402 may include a printed coil antenna 1410 having a desired pattern and may be coupled to one or more of the conductive portion 1424 and/or the control circuitry 1430. Further, the antenna portion 1402 may include a center opening 1420 which may be used to provide a passage for BB/BCR. Further, the printed coil antenna may include vias which may connect portions of loops.

Figure 15:
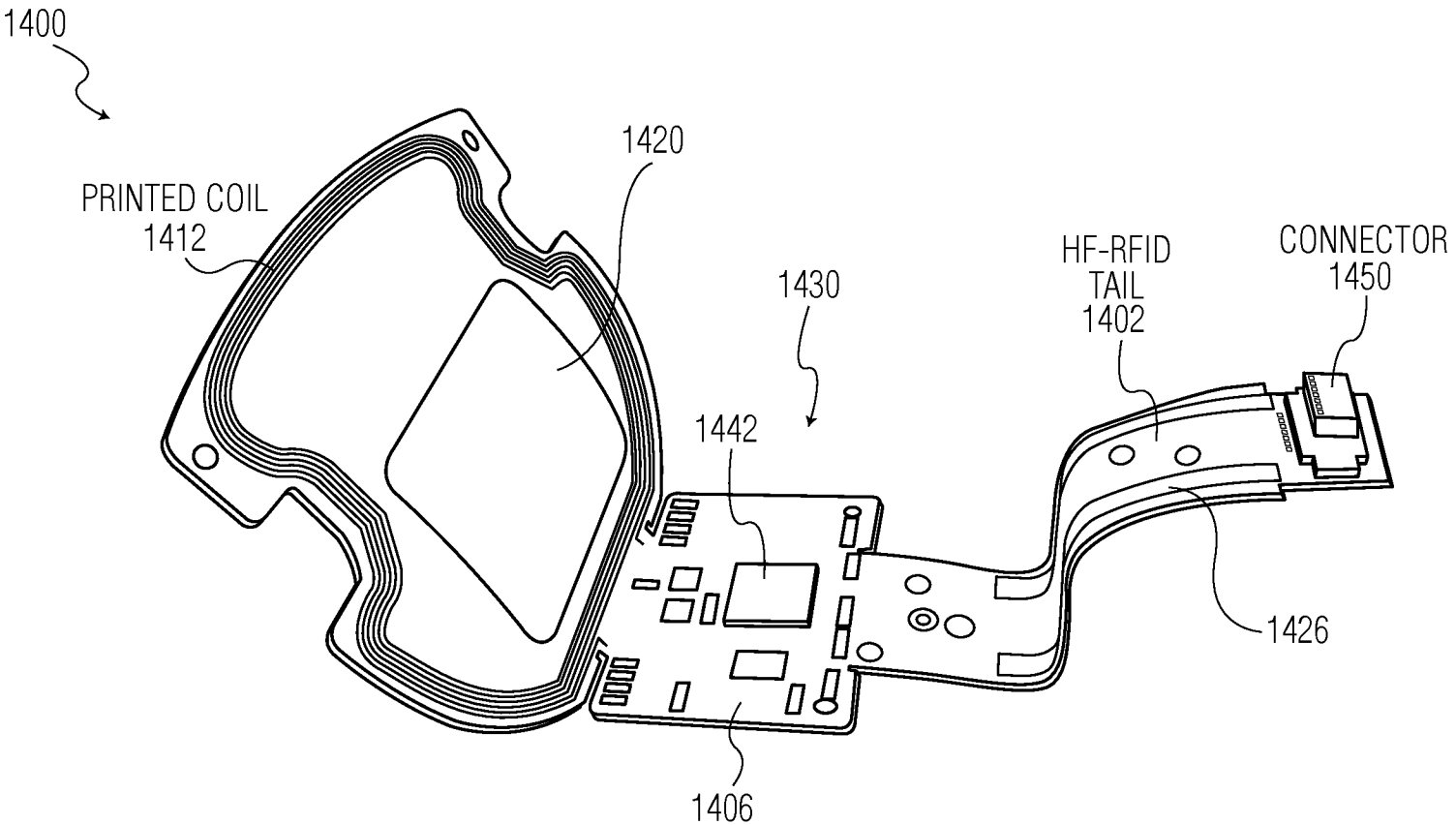
FIG. 15 is a perspective view of an antenna module of FIG. 14 in accordance with embodiments of the present system.

FIG. 15 is a perspective view of an antenna module 1400 of FIG. 14 in accordance with embodiments of the present system. The substrate 1402 is partially folded to illustrate a folding method and folding portions. The substrate portion 1402 may include reinforcing areas such as in the layout portion 1406 to increase the rigidity of the layout portion 1406.

Figure 16:
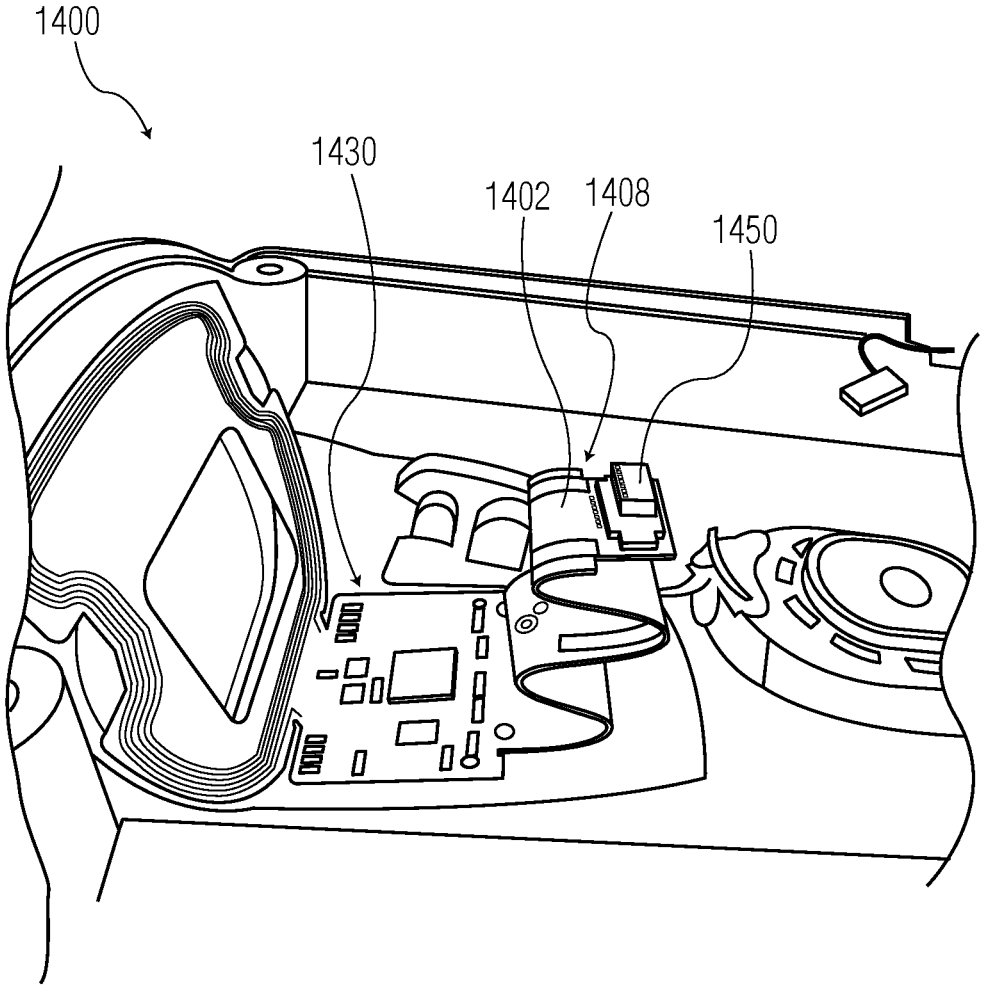
FIG. 16 is a perspective view of an antenna module of FIG. 14 in mounted in an MS in accordance with embodiments of the present system.

FIG. 16 is a perspective view of an antenna module 1400 of FIG. 14 in mounted in an MS 1408 in accordance with embodiments of the present system. The connector 1450 is folded and has not yet been coupled to a PCB of the MS 1408.

Figure 17:
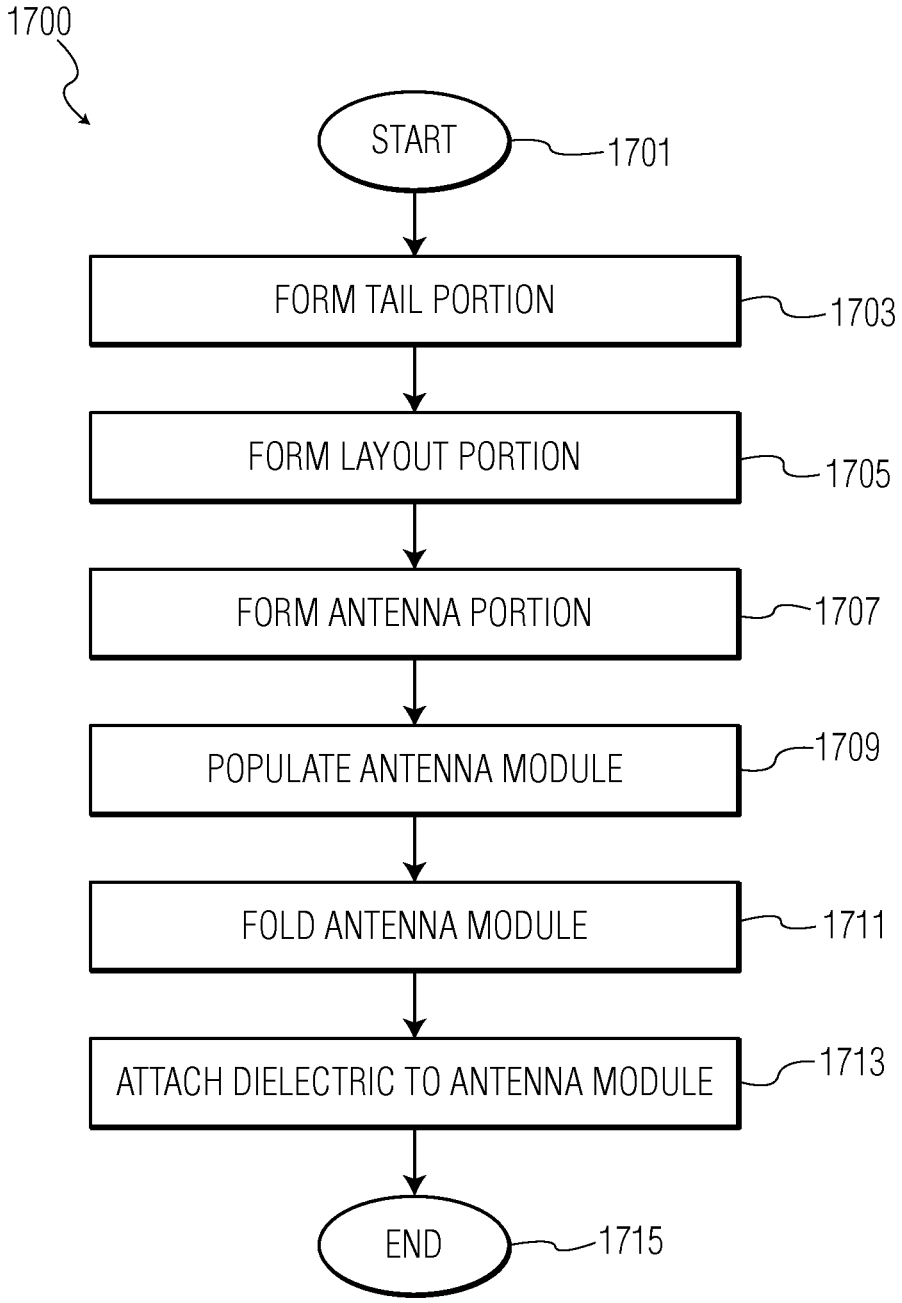
FIG. 17 shows a flow diagram that illustrates a process in accordance with embodiments of the present system.

FIG. 17 shows a flow diagram that illustrates a process 1700 in accordance with embodiments of the present system. The process 1700 may be performed using one or more computers communicating over a network. The process 1700 may include one of more of the following acts. Further, one or more of these acts may be combined and/or separated into sub-acts, if desired. In operation, the process may start during act 1701 and then proceed to act 1703.

During act 1703, the process may form a tail portion of an antenna module having a flexible substrate and side edge BALUN. Accordingly, the process may form a conductive pattern which may form part of the side edge BALUN on the substrate using any suitable method (e.g., deposition, printing, etc.). The conductive pattern may include a center portion and side portions on either side of the center portion such that a slot may be located between the center portion and corresponding side portions. The center portion and the side portions may extend along a longitudinal length of the tail portion. The substrate may include a flexible substrate such as a flexible printed circuit (FPC). After completing act 1703, the process may continue to act 1705.

During act 1705, the process may form a layout portion of the antenna module. The layout portion may include a conductive pattern which may be coupled to one or more active and/or passive circuit portions (e.g., resistors, diodes, inductors, controllers, processors, digital signal processors, etc.) and may include a ground plane coupled to the conductive portion of the tail portion. The process may also attach a rigidity enhancing portion such as a printed circuit board (PCB) to the substrate. After completing act 1705, the process may continue to act 1707.

During act 1707, the process may form an antenna portion of the antenna module. Accordingly, the process may form an antenna pattern on the substrate using any suitable method (e.g., deposition, printing, etc.). The antenna portion may be tuned to operate at a certain frequency and may include a predefined shape and size (e.g., a loop, etc.). The antenna pattern may include one or more leads which may be electrically coupled to the conductive pattern of the layout portion and/or the tail portion.

Further, the process may attach a ferrite sheet to a major surface of the substrate. After completing act 1707, the process may continue to act 1709.

During act 1709, the process may populate the antenna module with active and/or inactive components such as, for example, connectors, resistors, capacitors, inductors, controllers, etc. Accordingly, the process may couple active and/or inactive circuit portions to the conductive patterns of the antenna, layout, and/or tail portions. The circuit portions may include control circuitry for receiving and/or transmitting signals via the antenna pattern. After completing act 1709, the process may continue to act 1711.

During act 1711, the process may fold the antenna module in one or more locations. By folding the antenna module, a operating frequency range of the antenna may be shifted or expanded to include another operating frequency range. Thereafter, during act 1713, the process may attach a dielectric material between adjacent folded portions of the substrate of the antenna module. After completing act 1713, the process may continue to act 1715, where it ends.

Figure 18:
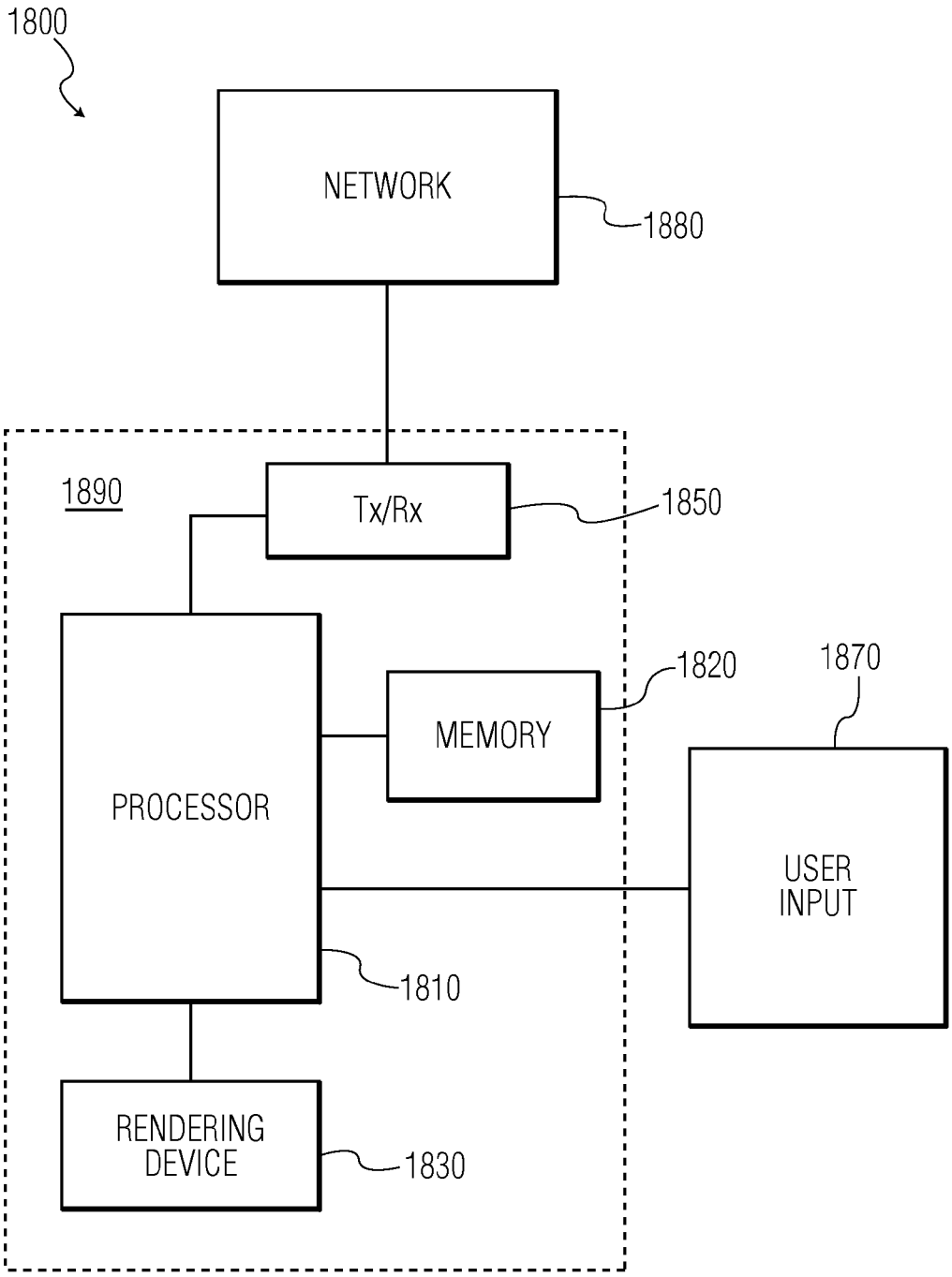
FIG. 18 shows a portion of a system (e.g., peer, server, etc.) in accordance with embodiments of the present system.

FIG. 18 shows a portion of a system 1800 (e.g., peer, server, etc.) in accordance with embodiments of the present system. For example, a portion of the present system may include a processor 1810 operationally coupled to a memory 1820, a display 1830, a Tx/Rx portion 1850, and a user input device 1870. The memory 1820 may be any type of device for storing application data as well as other data related to the described operation. The application data and other data are received by the processor 1810 for configuring (e.g., programming) the processor 1810 to perform operation acts in accordance with the present system. The processor 1810 so configured becomes a special purpose machine particularly suited for performing in accordance with the present system.

The Tx/Rx portion 1850 may include one or more antennas to wirelessly transmit and/or receive information from the network 1880. Further, one or more other devices or systems (MSs, RFID devices, computers, etc.) may also communicate with the system 1800. Accordingly, the Tx/Rx portion 1850 may include circuitry for upconverting a signal for transmission via an antenna of the present system and downconverting a received signal so as to wirelessly transmit or receive information. The Tx/Rx portion 1850 may include antennas which may operate using one or more transmission protocols and which may be configured in accordance with embodiments of the present system.

The operation acts may include requesting, providing, and/or rendering of content. The user input 1870 may include a keyboard, mouse, trackball or other device, including touch sensitive displays, which may be stand alone or be a part of a system, such as part of a personal computer, personal digital assistant, mobile phone, set top box, television or other device for communicating with the processor 1810 via any operable link. The user input device 1870 may be operable for interacting with the processor 1810 including enabling interaction within a UI as described herein. Clearly the processor 1810, the memory 1820, display 1830 and/or user input device 1870 may all or partly be a portion of a computer system or other device such as a client and/or server as described herein.

The methods of the present system are particularly suited to be carried out by a computer software program, such program containing modules corresponding to one or more of the individual steps or acts described and/or envisioned by the present system. Such program may of course be embodied in a computer-readable medium, such as an integrated chip, a peripheral device or memory, such as the memory 1820 or other memory coupled to the processor 1810.

The program and/or program portions contained in the memory 1820 configure the processor 1810 to implement the methods, operational acts, and functions disclosed herein. The processor 1510 so configured becomes a special purpose machine particularly suited for performing in accordance with the present system.

The processor 1810 is operable for providing control signals and/or performing operations in response to input signals from the user input device 18180 as well as in response to other devices of a network and executing instructions stored in the memory 1820. The processor 1810 may be an application-specific or general-use integrated circuit(s). Further, the processor 1810 may be a dedicated processor for performing in accordance with the present system or may be a general-purpose processor wherein only one of many functions operates for performing in accordance with the present system. The processor 1810 may operate utilizing a program portion, multiple program segments, or may be a hardware device utilizing a dedicated or multi-purpose integrated circuit.

Although the antenna of the present system has been described with reference to the IEEE 802.11-x standard and/or the Bluetooth technology, it is envisioned that the antenna of the present system may also be compatible with, for example, the IEEE 802.14.4-2003 (ZigBee™) standard, and/or other technologies, standards, and/or protocols. Accordingly, the present system may provide an antenna module which may be incorporated in MSs having one or more other antennas for transmission or reception of information using other protocols (e.g., CDMA, GSM, etc.).

Further, the present system may provide a convenient method to integrate FPC antenna modules (e.g., an FPC of an HF-RFID reader/writer) in MSs in close proximity to existing (e.g., additional antenna) antennas such as WiFi/BT antennas. Further, the present system may provide mutual-coupling suppression from an HF-RFID interconnect tail to WiFi/BT antennas through an embedded side edge-BALUN of the present system and a grounded point for coupling the tail portion of the HF-RFID antenna to a PCB board of an MS. Accordingly, the present system may enhance return-loss and radiation performance of RF antennas. In accordance with embodiments of the present system, other devices with different frequency bands may be readily accommodated.

Further variations of the present system would readily occur to a person of ordinary skill in the art and are encompassed by the following claims. Through operation of the present system, a virtual environment solicitation is provided to a user to enable simple immersion into a virtual environment and its objects.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. In addition, the section headings included herein are intended to facilitate a review but are not intended to limit the scope of the present system. Accordingly, the specification and drawings are to be regarded in an illustrative manner and are not intended to limit the scope of the appended claims.

The section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is claimed is:

1. An antenna module apparatus having a side-edge balance-to-unbalance (BALUN), the apparatus comprising:

a flexible substrate having one or more layers and configured to receive first and second conductive patterns, the flexible substrate having first and second ends defining a longitudinal length and opposed side edges between the first and second ends, wherein:

the first conductive pattern forms an antenna loop situated adjacent to the first end of the flexible substrate, and is configured to transmit or receive signals;

the second conductive pattern and forms at least part of the BALUN and has a center portion, side portions extending from the center portion and located on opposite sides of the center portion, and electrically neutral slots situated between a corresponding side portion and the center portion, wherein the second conductive portion configured to form an electrical ground for the antenna module.

2. The apparatus of claim 1, further comprising a control portion having at least one processor situated between the first conductive pattern and the second end of the substrate and configured to process signals for transmission by the antenna or process signals received from the antenna.

3. The apparatus of claim 1, wherein each side portion of the side portions extends along a portion of an adjacent side edge of the opposed side edges of the substrate.

4. The apparatus of claim 1, further comprising one or more folds located between the first and second ends of the substrate.

5. The apparatus of claim 1, further comprising an opening in the substrate situated within an area situated within a loop of the antenna loop.

6. The apparatus of claim 1, wherein a length of one or more of the center portion, side portions, and electrically neutral slots are adjusted to change a conductance of the center portion in one or more locations.

* * * * *